US006550829B1

(12) United States Patent
Dobson

(10) Patent No.: US 6,550,829 B1
(45) Date of Patent: Apr. 22, 2003

(54) CARGO SECURITY SEAL

(76) Inventor: DeWayne L. Dobson, 2190 W. 70 N., Angola, IN (US) 46703

( * ) Notice: Subject to any disclaimer, the term of this patent is extended or adjusted under 35 U.S.C. 154(b) by 0 days.

(21) Appl. No.: 09/500,682

(22) Filed: Feb. 9, 2000

(51) Int. Cl.[7] ..... F05B 39/02
(52) U.S. Cl. ..... 292/327; 70/50; 70/53
(58) Field of Search ..... 292/327; 70/50, 70/53

(56) References Cited

U.S. PATENT DOCUMENTS 3,862,775 A * 1/1975 Gudmundsen ..... 292/327
3,945,671 A * 3/1976 Gerlach ..... 292/327
4,280,726 A * 7/1981 McCoag ..... 292/327
4,802,699 A * 2/1989 Smith ..... 292/327
4,802,700 A * 2/1989 Stevenson et al. ..... 292/327
5,005,883 A * 4/1991 Guiler ..... 292/327
5,127,687 A * 7/1992 Guiler ..... 292/327
5,161,838 A * 11/1992 Ely et al. ..... 292/327
5,582,447 A * 12/1996 Leon et al. ..... 292/327
5,732,989 A * 3/1998 Stevenson et al. ..... 292/327
5,769,470 A * 6/1998 Toyomura ..... 292/327

* cited by examiner

*Primary Examiner*—Christopher P. Schwartz
*Assistant Examiner*—Devon Kramer
(74) *Attorney, Agent, or Firm*—Krieg DeVault Lundy LLP

(57) ABSTRACT

A new and improved bolt seal which provides an elongated tube or an elongated bolt, having one or more ribs or grooves thereon for engaging a lock body, and a lock body which may be slid onto the end of the bolt to engage the ribs or grooves of the bolt. The lock body has a spring clip or a lock ring therein which when positioned in a locked position engages the ribs or grooves of the bolt in a non-removable manner.

60 Claims, 9 Drawing Sheets

CARGO SECURITY SEAL

BACKGROUND OF THE INVENTION

This invention relates to cargo security seals, and more particularly to bolt seal assemblies for use as seals for doors of railroad cars, trailer trucks and the like.

Some of the more significant problems facing the transportation industry over the years have been thefts from railroad cars, trailer trucks, transport containers and the like. These thefts often occur in railroad freight yards where the cars, trucks and containers may be located while awaiting further transport.

Locking seals are employed to protect the contents of locked rail cars, trucks, and shipping containers. The typical locking seal is destroyed when opened and typically employed to show tampering with a locked compartment. Locking seals are usually not intended to prevent the door from being opened but only to indicate when the door has been opened by unauthorized personnel.

In the past, locking seals have ranged from cable locks wherein the opposite ends of the cable are locked by a self adjusting cable gripping device to pad locks. Typical cable seals include a cable gripping structure having a bore through which the cable is positioned. When the locking device is slid under the cable and desirably positioned, the cable lock is secured to the cable. Any attempt to remove the locking device from the cable in a reverse direction is precluded by the gripping structure within the unit bore. Cable gripping units are disclosed in U.S. Pat. Nos. 3,852,850; 3,868,748; 3,994,521; 1,577,678; 889,776; 4,747,631; 4,681,356; 4,681,355; 4,640,538; 4,312,529. Where the railroad car, trailer truck, container or the like is already provided with a hasp, pad locks and bolt locks may be used. Pad locks have been found to be impractical because of their cost and the problem of the transfer of keys with the railroad car, trailer truck or transport container or the like. Most pad locks were found to be removed by bolt cutters and therefore not reusable.

To solve this problem, a variety of bolt locks were provided. These bolt locks provided the required seal for the railroad cars, trailer trucks, shipping containers and the like, but were much less expensive to manufacture than a pad lock. Bolt locks were proposed to be disposable upon being removed by a bolt cutter or the like.

Various one time seals are disclosed in U.S. Pat. Nos. 4,690,443; 4,802,700; 4,280,726; and 4,681,356. The problem of course, with one time seals is the need to replace the seal once removed and the relative cost of the seal and the security of the seal.

A variety of one time bolt seals are commercially available. One type is disclosed in U.S. Pat. No. 4,802,700 employing a straight seal rod with a screw or rivet type locking head on one end. The rod has a circumferential groove. The locking seal has a spring ring which engages a groove in the seal body and the rod groove for locking the rod in a fixed axial position relative to the seal. The free end is inserted through the opening of a hasp on a door, for example, with the head on one side of the hasp and the locking seal on the other side of the hasp. To remove the lock seal from the hasp, a commercially available bolt cutter is used. In other seal arrangements, the bolt shaft may be bent so that one shaft portion is inclined relative to a second shaft portion with a head at one end and a seal being locked to the other end. In other bolt seals, the locking seal may be slid along the bolt shaft for locking to the bolt at different axial positions. See, for example, U.S. Pat. Nos. 5,413,393; 5,347,689; and 5,450,657. In U.S. Pat. Nos. 5,347,689 and 5,413,393, a rigid steel bolt shaft has annular grooves which are engaged by a mating collate in a cavity in the seal body.

A cable cutter is used to break the seal of U.S. Pat. No. 5,450,657. However, the bolts of U.S. Pat. Nos. 5,413,393 and 5,347,689 have weakening links at the bolt ends so that the head and bolt when bent will sever the head and swaged bolt portion from the rest of the bolt. In certain of the above patents, the seal may slide along the bolt so as to position the bolt head and the seal against the hasp to preclude the breaking of the seal with a bolt cutter. U.S. Pat. No. 5,413,393 is provided with a spacer to provide room for a bending tool for use by an authorized user.

It is therefore highly desirable to provide a new and improved bolt seal. It is also highly desirable to provide a new and improved bolt seal which is less expensive to manufacture. It is also highly desirable to provide a new and improved bolt seal which is more secure than prior seals. It is also highly desirable to provide a new and improved bolt seal which is less likely to hide tampering.

Some of the prior art bolt seals are difficult to remove. It is therefore also highly desirable to provide a new and improved bolt seal which is easily removed using readily available tools.

It is also highly desirable to provide a universal bolt seal assembly that meets all of the requirements of both bolt seals which allow the seal to slide along the bolt and bolt seals which position the head and the seal adjacent the hasp to make tampering more difficult and bolt seals that can be removed without specialized tooling.

Finally, it is highly desirable to provide a new and improved bolt seal which has each of these features.

SUMMARY OF THE INVENTION

It is therefore an object of the invention to provide a new and improved bolt seal. It is also highly desirable to provide a new and improved bolt seal which is less expensive to manufacture.

It is also an object of the invention to provide a new and improved bolt seal which is more secure than prior seals.

It is also an object of the invention to provide a new and improved bolt seal which is less likely to hide tampering.

It is also an object of the invention to provide a new and improved bolt seal which is easily removed using readily available tools.

It is also an object of the invention to provide a universal bolt seal assembly that meets all of the requirements of both bolt seals which allow the seal to slide along the bolt and bolt seals which position the head and the seal adjacent the hasp to make tampering more difficult and bolt seals that can be removed without specialized tooling.

It is finally an object of the invention to provide a new and improved bolt seal which has each of these features.

In the broader aspects of the invention, there is provided a new and improved bolt seal which provides an elongated tube or an elongated bolt, having one or more ribs or grooves thereon for engaging a lock body, and a lock body which may be slid onto the end of the bolt to engage the ribs or grooves of the bolt. The lock body has a spring clip or a lock ring therein which when positioned in a locked position engages the ribs or grooves of the bolt in a non-removable manner.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
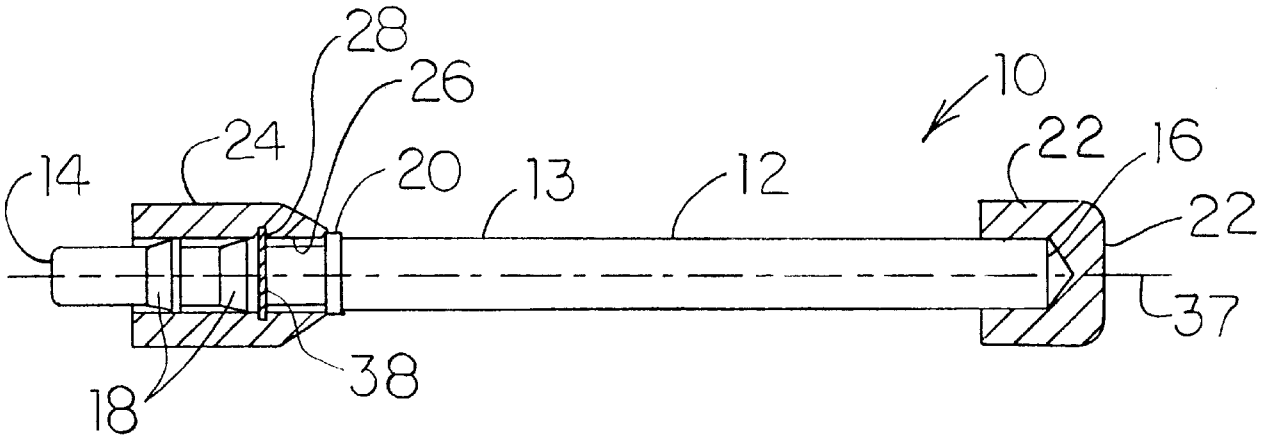
FIG. 1 is a partial cross-sectional view of the new and improved security seal of the invention showing the lock body and the head in cross-section and the bolt of the invention in full.

Referring to FIGS. 1, 2 and 7 through 15, there is shown the new and improved security seal of the invention. Security seal 10 comprises a bolt 12 having opposite ends 14, 16, a lock retainer 18 adjacent end 14 and an anti-tampering device 20 spaced therefrom toward end 14. As shown in FIG. 1, bolt 10 may have a head 22 attached to end 16.

Security seal 10 also has a lock body 24 having a passageway 26 extending therethrough with a grooves 28 extending radially of the passageway. Groove 28 is midway between the opposite ends of the lock body and has a bottom 30 and upstanding sides 32 which are essentially parallel and extend perpendicularly to the walls of the passageway 26. Lock body 24, in the embodiment shown in FIGS. 1, 2 and 7 through 16, abuts anti-tampering device 20 when the lock ring 38 is in the groove 28 and lock body 24 is locked on bolt 12. End 34 is tapered from the surface 13 of the bolt 12 to the exterior surface 36 of the lock body 24.

Lock ring 38 is an expandable ring which is loosely positioned within the groove 28 of the lock body 24. The lock ring 38 expands into the groove 28 to allow the bolt 12 to be positioned in passageway 26. Lock ring 38 engages both the bolt 12 and the lock body to prevent the bolt from being removed from the lock body 24 once positioned therein as will be explained hereinafter.

The bolt 12 is formed of a thin walled tube having an interior passageway in which an electronic tamper evident device and/or global positioning system may be placed. See FIG. 2. The tube is cut to length and deburred. A bullet nose end form is provided at end 14 and a "double bead" operation is performed to form both the anti-tampering device 20 and the locking bead or retainer 18. As will be mentioned hereinafter, the anti-tampering device 20 is a bead which covers the lock body opening thereby preventing tampering with the lock body. Two locking beads or retainers 18 are shown on the bolt between end 14 and the anti-tampering device 20. Each of the locking retainers 18 include a lock retainer surface 40 which extends radially outwardly from the bolt 12, a cylindrical surface 42 which extends generally.parallel to the surface 13 of the bolt 12 and a tapered surface 44 which extends from the flat surface 42 to the bolt surface 13 toward end 14. Surface 42 is coaxially positioned of the bolt 10, and separates the retaining surface 40 and the tapered surface 44.

In a specific embodiment in which the bolt 12 is formed of 0.035 inch walled tube, the anti-tampering bead 20 measures axially of the bolt 0.062 inches, and is spaced from end 14 1.430 inches, and each of the retaining beads have a tapered surface 44 measuring axially of the bolt 12 0.128 inches and a cylindrical surface measuring 0.06 inches. The lock retaining bead 18 is spaced from the anti-tampering bead 20 0.375 inches and lock retaining bead 18 has a cylindrical surface 42 of about 0.06 inches, and a tapered surface 44 of about 0.128 inches which defines an angle of about 15° with the axis 37 of bolt 12, plus or minus 5°. If two locking retainer beads are utilized, the lock retaining surfaces 40 are spaced apart about 0.375 inches.

The lock body 24 is machined of stock 0.75 diameter steel. The passageway 24, in a specific embodiment, is utilized with a bolt of 0.375 inches machined to have a diameter of 0.390 inches. The groove 28 is formed to have side walls 22 spaced approximately 0.045 inches apart and cylindrical bottom 30 having a diameter of approximately 0.495 inches. Groove 28 is approximately 0.641 inches from end 35, and tapered surface 36 generally defines an angle with the axis 37 of lock body 24 of approximately 30°.

Figure 10:
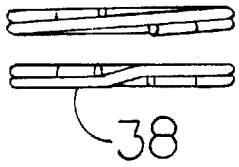
FIG. 10 is a side view of the lock ring of the security seal shown in FIGS. 1, 2, 16 and 17.
Figure 11:
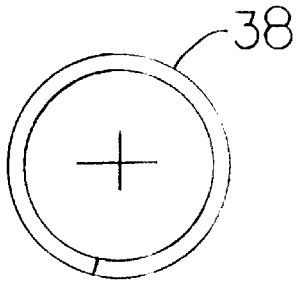
FIG. 11 is an end view of the lock ring of the security seal shown in FIGS. 1, 2, 16 and 17.
Figure 13:
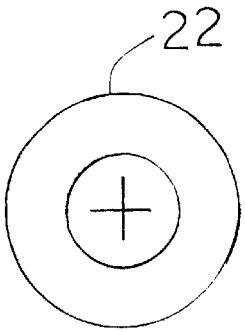
FIG. 13 is an end view of the head of the security seal shown in FIGS. 1 and 2.
Figure 12:
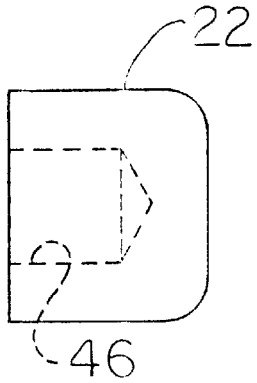
FIG. 12 is a side view of the head of the security seal shown in FIGS. 1 and 2.
Figure 14:
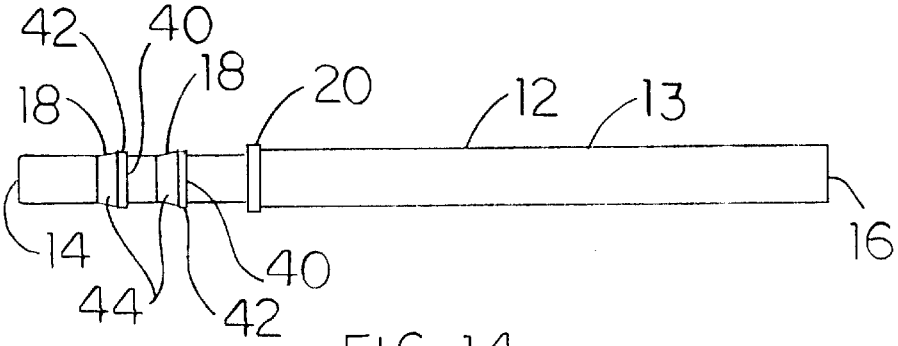
FIG. 14 is a side view of the bolt of the security seal shown in FIGS. 1 and 2.
Figure 15:
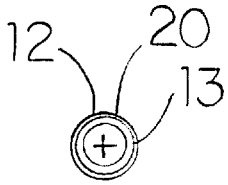
FIG. 15 is an end view of the bolt of the security seal shown in FIGS. 1 and 2.

Lock ring 38 may take a number of forms. A conventional expandable C-ring can be utilized. Additionally, a spirally round expandable ring 38 as shown in FIGS. 10 and 11 can also be utilized. Both such rings would have an interior diameter of approximately 0.312 and an exterior diameter of approximately 0.412 and a thickness of approximately 0.35 in order to be utilized with a groove 28 as in the specific embodiment hereinabove dimensioned.

Figure 2:
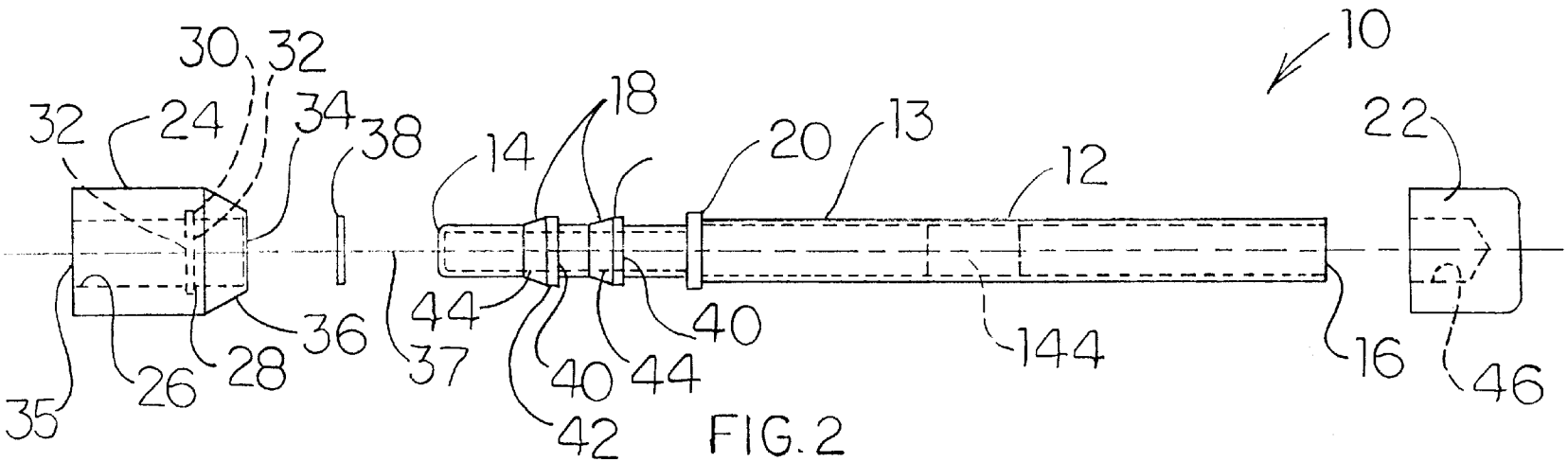
FIG. 2 is an exploded view of the new and improved security seal of the invention shown in FIG. 1.
Figure 4:
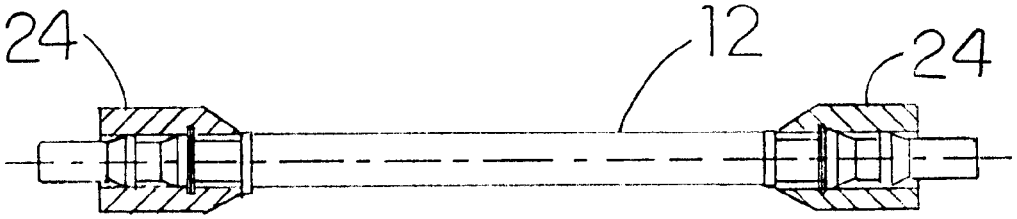
FIG. 4 is a modified version of the new and improved security seal of the invention having a lock body at both ends of the bolt.
Figure 5:
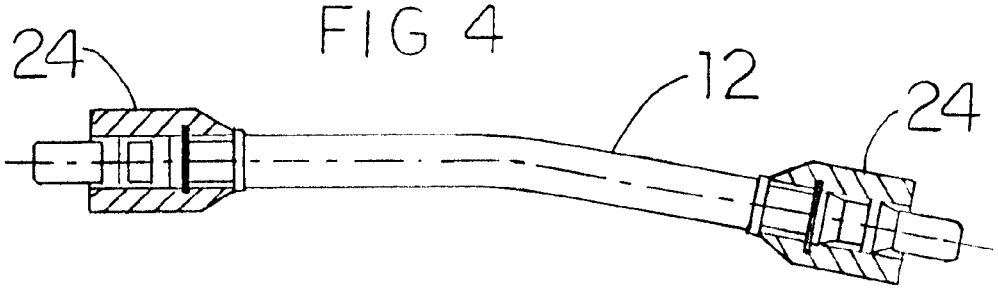
FIG. 5 is a view like FIG. 3 of the security seal of FIG. 4 having a bent bolt.
Figure 6:
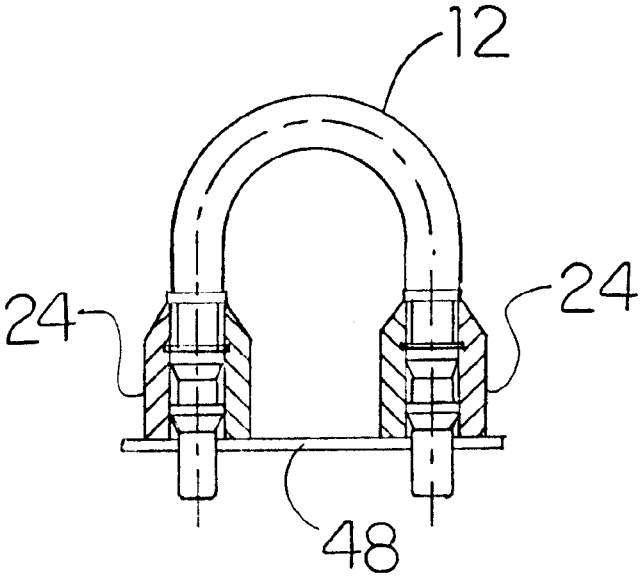
FIG. 6 is a U-shaped security seal of the version shown in FIGS. 4 and 5.

Adjacent end 16 of bolt 12, there may be positioned a head 22 as shown in FIGS. 1 and 2 or an identical set of anti-tampering 20 and lock retaining 18 beads as shown in FIGS. 4 through 6.

When the head 22 is used in a specific embodiment, head 22 is machined from steel stock having an outside diameter of 0.0750 inches. A 0.390 inch bore 46 is placed in head 22 to accommodate the bolt 12. Head 22 in one embodiment is connected to bolt 22 by brazing.

Figure 7:
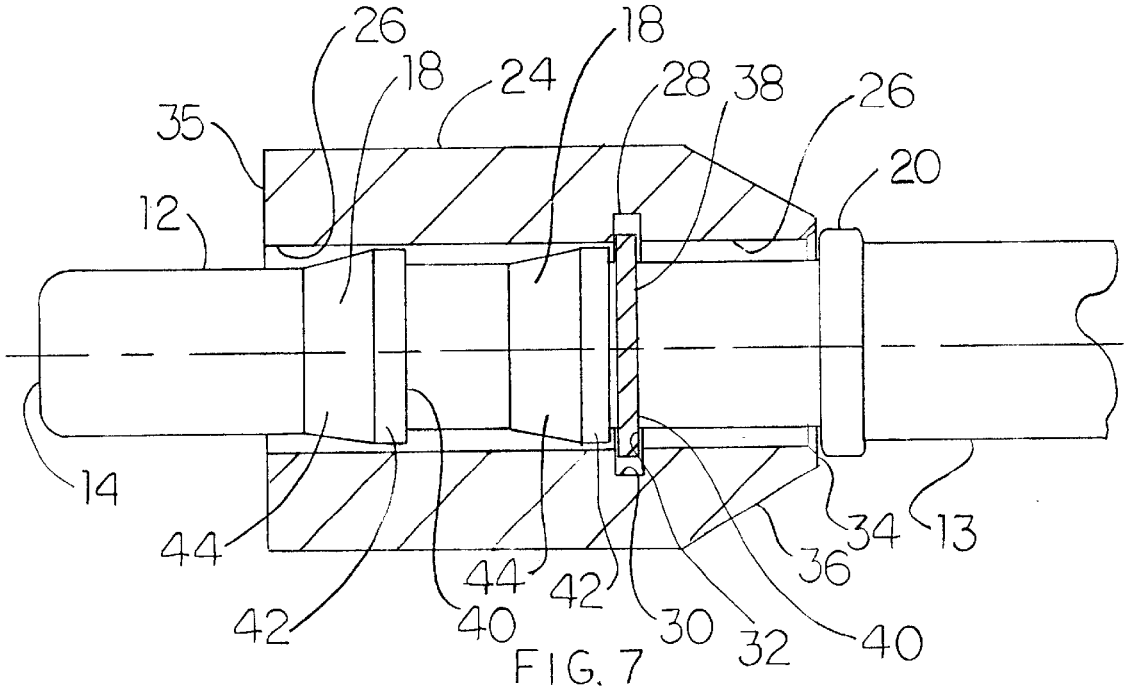
FIG. 7 is a fragmentary enlarged view of the lock body end of the new and improved security seal shown in FIGS. 1 and 2.
Figure 8:
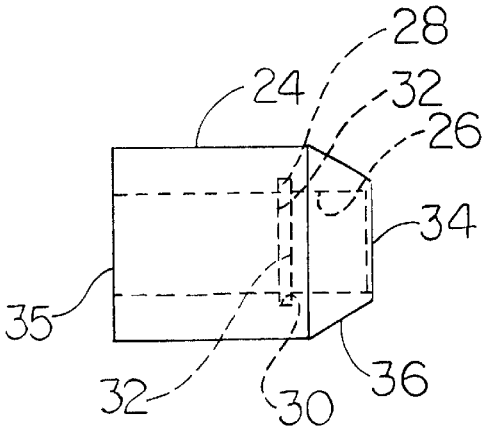
FIG. 8 is a side view of the lock body of the seal shown in FIGS. 1 and 2.
Figure 9:
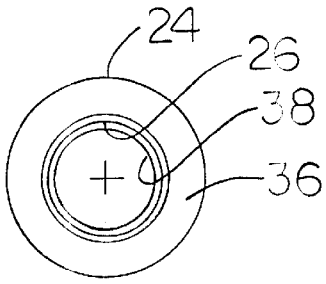
FIG. 9 is an end view of the lock body of the seal shown in FIGS. 1 and 2.

FIG. 7 illustrates with clarity the lock body 24 assembled on bolt 12. Lock body 24 is slid onto bolt 12 from end 14 with the tapered surface 36 and end 34 leading the way. Lock ring 38 is expanded into groove 28 by the lock retainer bead 18 as it passes through the lock ring. The lock ring 38 collapses to its at rest position after it passes the lock retaining bead 18 and rests adjacent lock retaining surface 40. In this position, because of the spacing between the lock retaining surface and the anti-tampering bead 20 and end 34 is adjacent and may even abut anti-tampering device 20 preventing tampering with the lock ring 38. Similarly, the lock retaining beads 18 prevent tampering from end 35 of lock body 24.

Figure 3:
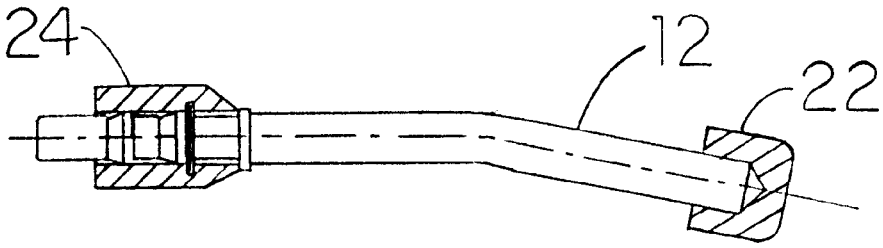
FIG. 3 is a figure like FIG. 1 with a bent bolt.

With regard to the versions shown in FIGS. 3 through 6, after the security seals 10 of the invention are formed as above described, bolt 12 is left straight as shown in FIG. 4 or bent as shown in FIGS. 3 and 5, or bent into a U-shape as shown in FIG. 6. FIG. 6 shows the lock body 24 of the opposite ends interconnected by a bar 48.

Figure 16:
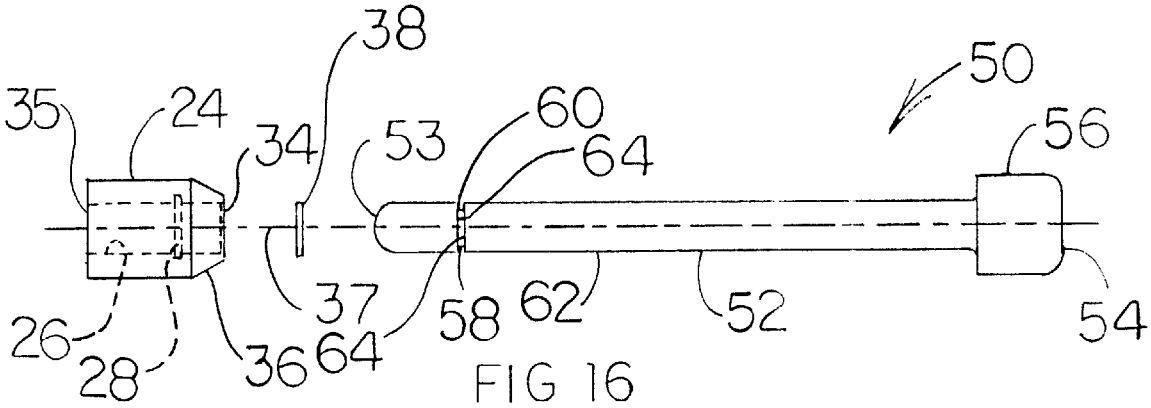
FIG. 16 is an exploded view like FIG. 2 of a modified version of the new and improved security seal shown in FIGS. 1 and 2 in which the bolt is solid.
Figure 17:
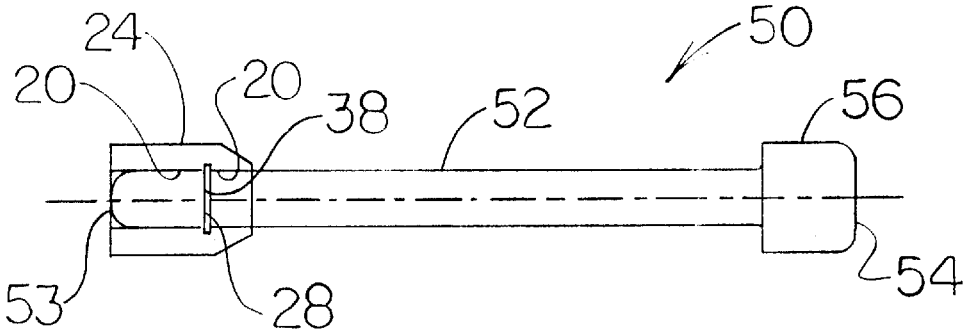
FIG. 17 is an assembled view like FIG. 1 of the solid bolt security seal shown in FIG. 11.
Figure 18:
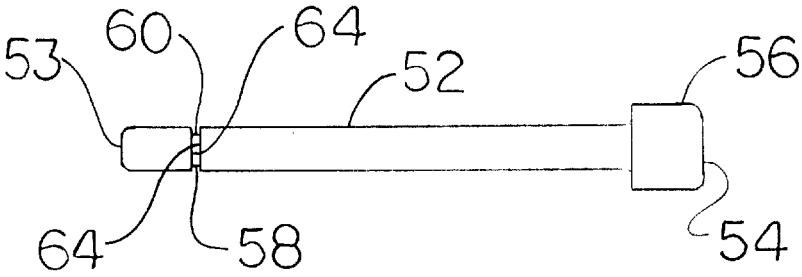
FIG. 18 is a side view of the solid bolt of the security seal shown in FIGS. 16 and 17.

In FIGS. 16 through 18, there is shown a modified version of the security seal of the invention. Seal 50 may utilize the same lock body 24 as previously described with regard to security seal 10. Security seal 50, however, utilizes a bolt 52 which is significantly different than bolt 12. The primary difference is that bolt 52 is solid (not tubular) rod stock having opposite ends 53, 54. Bolt 52 is machined from solid rod stock. End 53 is bullet shaped by machining, end 54 is either bullet shaped by machining or has a head 56 machined thereon. Groove 58 has a cylindrical bottom 60 which is coplanar of the bolt surface 62 and upstanding sides 64 which are shaped apart and generally perpendicular to the bolt axis 37. Security seal 50 like security seal 10, utilizes a lock ring 38 positioned within groove 28 of lock body 24.

Lock body 24 is positioned on bolt 52 by entering end 53 into end 34 of lock body 24 and pushing bolt 52 toward end 35 of lock body 24 until the retaining ring within the groove 28 drops into the lock groove 58 of bolt 52. Lock ring 38 in security seal 50 may be of either type hereinabove described.

In a specific embodiment, bolt 52 has an exterior diameter of approximately 0.375 inches, groove 58 has a bottom which has a diameter of approximately 0.312, inches and side walls 64 are separated approximately 0.045 inches. Groove 58 is spaced from end 53 approximately 0.641 inches.

The anti-tampering device 20 of the security seal 50 takes the form complementary bolt surface in contact over its entire surface of passageway 26 of lock body 24 on both sides of grooves 58 and 28 when lock body 24 is assembled on bolt 52. See FIG. 17.

In specific embodiments, bolt 52 may either have a second groove 58 or a head 66 at end 54. In the embodiment having a head 56, the head has a diameter of approximately 0.750 inches and has an axial length of about 0.625 inches and is generally bullet shaped at its distal end. Each of the embodiments shown in FIGS. 3 through 6 may be formed of security seal 50 as well as security seal 10.

Figure 19:
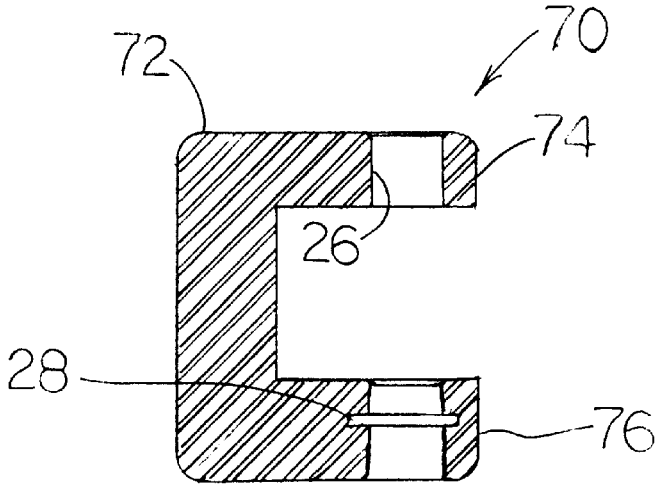
FIG. 19 is cross-sectional side view through the center lines of the passage way of a modified lock nut for the new and improved security seal of the invention shown in FIGS. 16, 17 and 18.
Figure 20:
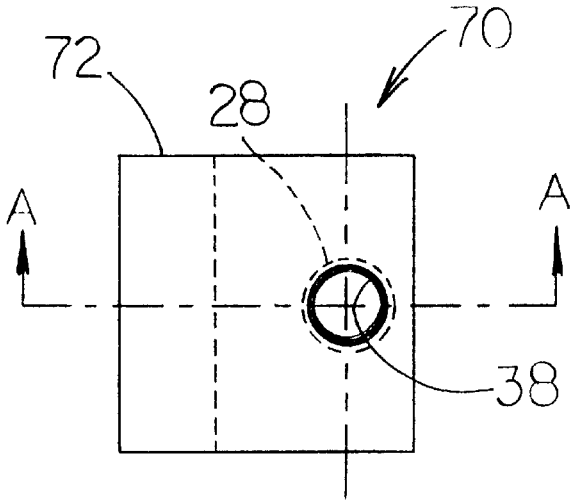
FIG. 20 is top view thereof.
Figure 21:
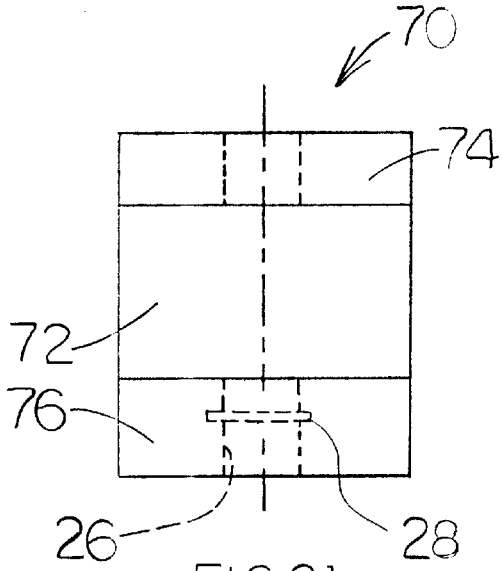
FIG. 21 is a front view of the modified lock nut of the invention shown in FIGS. 19 and 20.

FIGS. 19 through 21 illustrate a modified lock body 70. Lock body 70 is generally U-shaped having a body 72 and opposite legs 74, 76. Passageway 26 extends through the legs 74, 76 as shown and lock groove 28 is positioned in passageway 26 as above described. Either bolt 12 or 52 may be utilized with this lock body provided an appropriate lock retainer 18 and anti-tampering device 20 is utilized. All of the lock retainers 18 and anti-tampering devices 20 above described may be utilized with the lock body 70.

FIGS. 19 through 21 illustrate a modified lock body 70. However, lock body 70 has a locking groove 28 which is the same as locking groove 28 of lock body 24. Locking groove 28 has a cylindrical bottom and upstanding sides.

Figure 22:
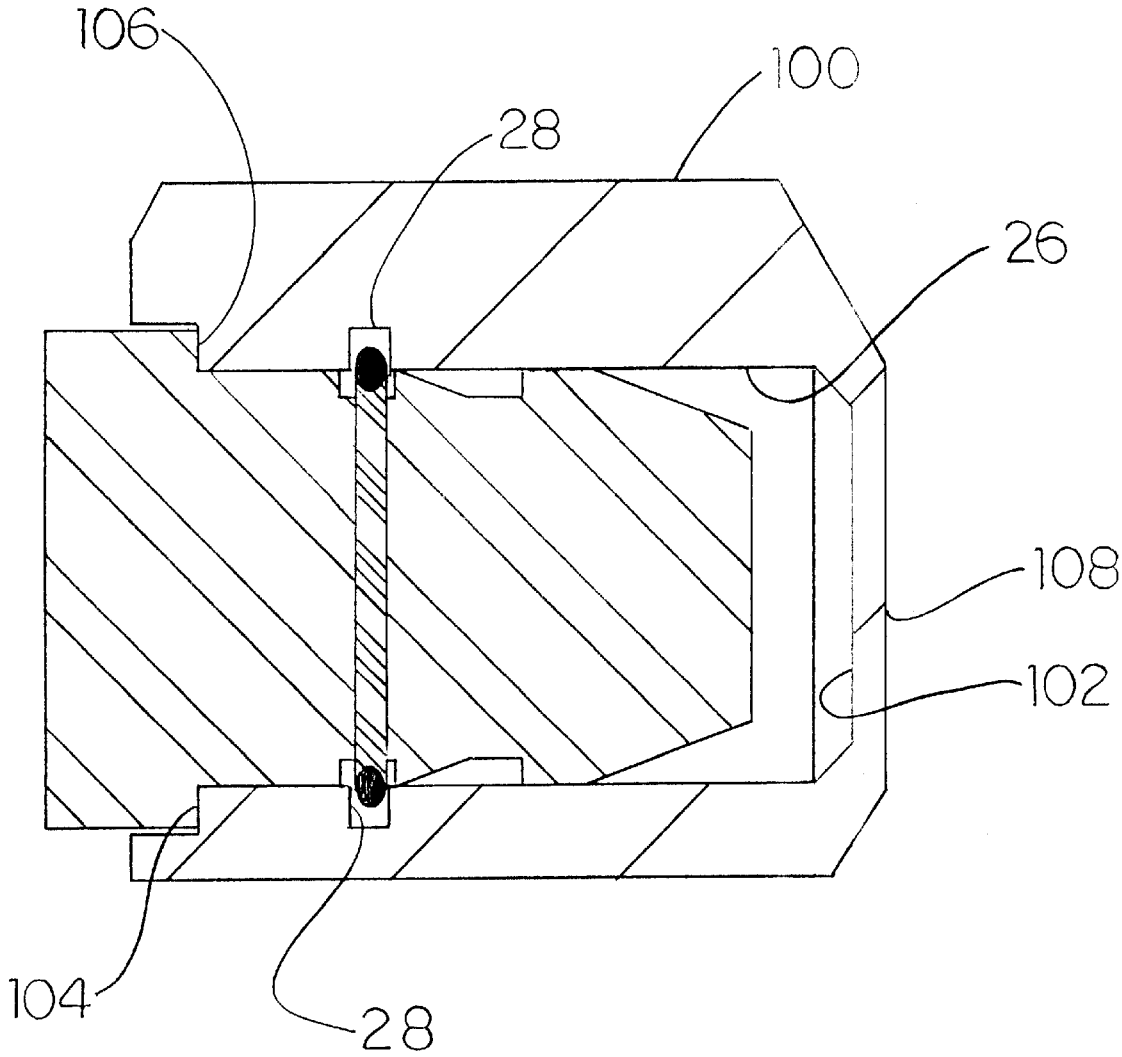
FIG. 22 is a side view of a modified version of the lock ring of the security seal shown in FIGS. 1, 2, 16 and 17.
Figure 23:
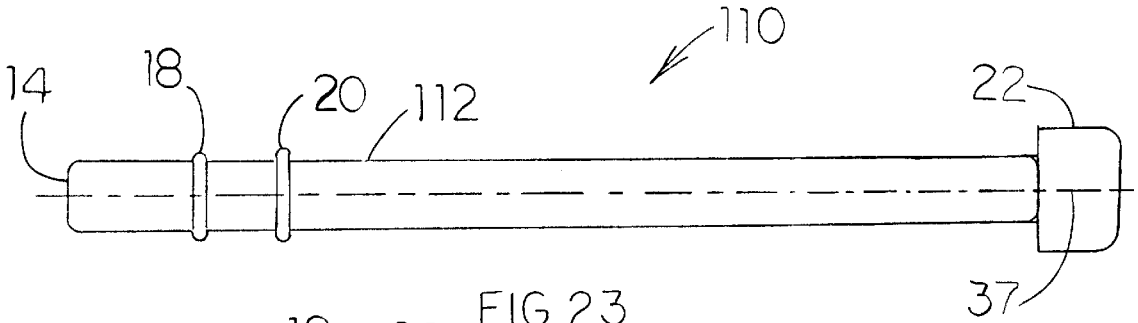
FIG. 23 is a side view of a modified version of the tubular bolt of the new and improved security seal of the invention as shown in FIG. 4.

Referring to FIG. 22, a third modified lock body 100 is shown. Lock body 100 is in the form of a cap having a structure similar to lock body 24. Thus, lock body 100 has a passageway 28 which has a bottom 102 and a groove 28 therein as above described. The anti-tampering device 20 is provided by a step diametered surface 104 of passageway 20 and a complementary step diametered surface 106 of bolt 12 or 50. In lock body 100, the anti-tampering device 20 also is in the form of the closed end 108 of lock body 100. In another embodiment, head 22 can be attached to the bolt by the very same structure as lock body 100. In this embodiment, lock body 100 becomes head 22.

Figure 24:
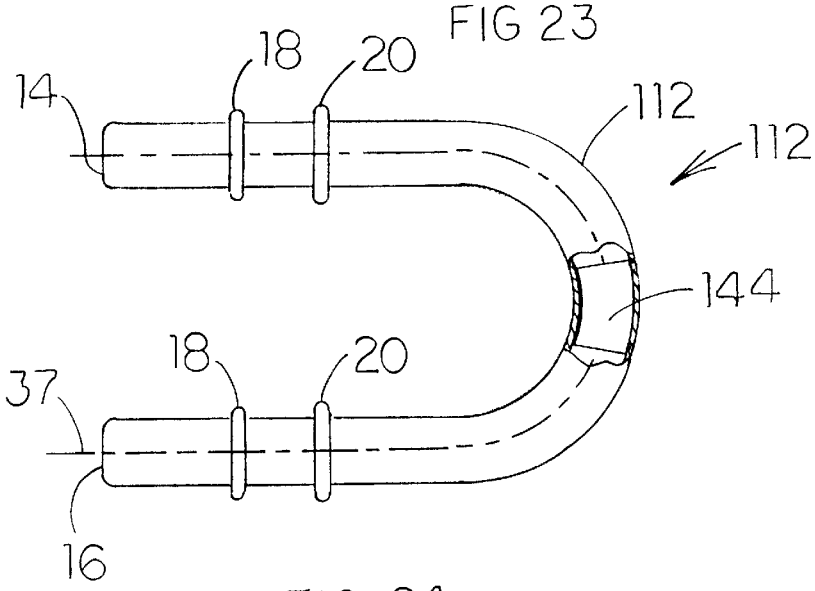
FIG. 24 is a view of the modified bolt shown in FIG. 23 in a bent U-shape.
Figure 26:
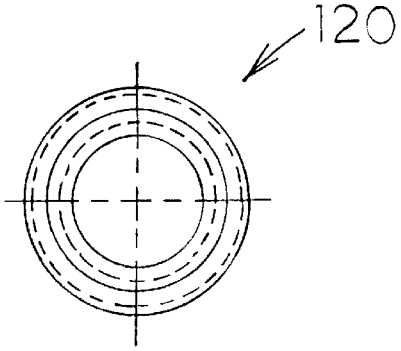
FIG. 26 is an end view of the lock body for use with the modified version of the bolt shown in FIGS. 23 and 24.
Figure 28:
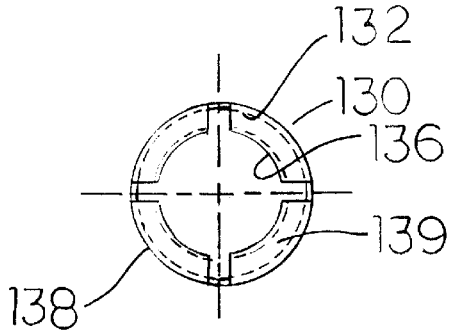
FIG. 28 is an end view of the lock positioned within the lock body shown in FIGS. 21 and 25.
Figure 25:
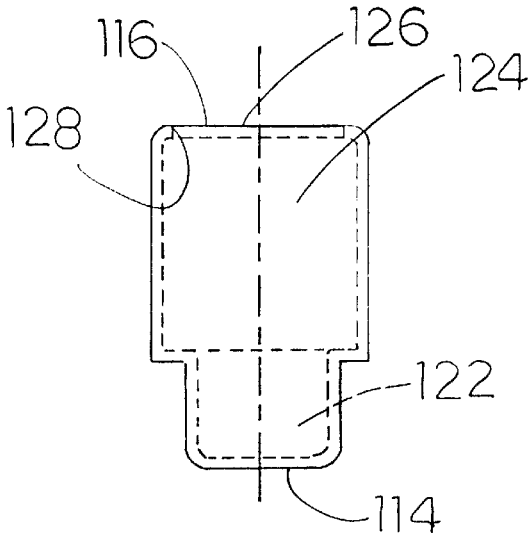
FIG. 25 is a cross-sectional side view of the lock body for use with the modified version of the bolt shown in FIGS. 23 and 24.
Figure 27:
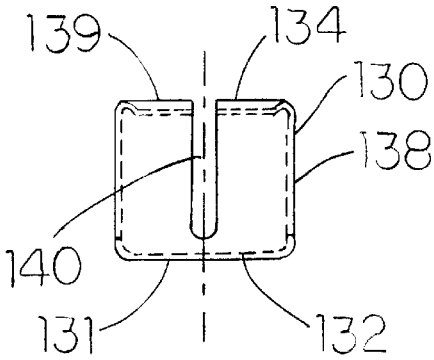
FIG. 27 is a side view of the lock positioned within the lock body shown in FIGS. 24 and 25.

Referring now to FIGS. 23 through 28 another modified version of the new and improved security seal of the invention is shown. Security seal 110 comprises a bolt 112 which, like the bolt 12 may have both a lock retaining bead 18 and an anti-tampering bead 20 formed adjacent each of the locking ends of the bolt. Bolt 112, like bolt 12, has an interior passageway in which an electronic tamper evident device and/or global positioning system 144 is positioned. Bolt 112 has opposite ends 14 and 16. In FIG. 24, both ends 14 and 16 are shown to be rounded and have spaced from the end both a lock retaining bead 18 and an anti-tampering bead 20 formed therein in a double bead operation. Bolt 112 is tubular like bolt 12 having a passageway 26. Instead of one pair of lock retaining bead 18 and anti-tampering bead 20, bolt 112 can also have a head 22 secured to one end thereof in the same manner as described with bolt 12 if desired as shown in FIG. 24. Security seal 110 can be formed into all of the bent, straight and U-shaped shapes hereinabove described and illustrated in FIGS. 1, 3, and 4 through 6. Bolt 112 can be formed in the same way as described hereinabove with regard to bolt 12.

Lock body 120 however, is significantly different from lock body 24. Lock body 120 is formed from sheet metal into a step diametered cap. Lock body 120 has a small diametered portion 122 which surrounds the bolt end, and a longer diameter portion 124 which encloses a spring lock 130 which grasps the lock retaining bead 18 of the seal 110. The large diametered end 116 has an opening 126 which allows the bolt 110 to be positioned therein. Surrounding the opening 126 is a crimped lip 128 against which the anti-tampering bead is positioned when the lock body 120 is locked onto the bolt 112 of the seal 110. A spring lock 130 is positioned within the larger diameter portion 124 of lock body 120. Spring lock 130 is formed from spring steel into a cylindrical shape having a bottom 131 with a bottom opening 132 therein, a top 134 with a top opening 136 therein and upstanding sides 138. The top opening 136 is defined by an upper lip 139 and both the upper lip 139 and the slides 138 are partially slotted from slots 140. Slots 140 allow the side and lip portions to be separated to spring inwardly and outwardly to overcome the lock retaining bead 20 of the seal 110.

In a specific embodiment, the tubular bolt 112 is formed of a metal 0.375 inch tube having a 0.35 wall thickness with an anti-tampering bead 20 positioned from the end approximately 1.062 inches and having an axial width of 0.062 inches. The lock retaining bead 18 is positioned from the same end approximately 0.75 inches and has the same measurement of 0.62 inches in width. The lock body 120 has an axial length of 1.125 inches. Large diameter portion 124 has an axial length of 0.812 inches, and small diameter portion 122 having an axial length of 0.313 inches. The exterior diameter of the lock body 120 is approximately 0.670 inches. The opening 126 defined by the crimped lip 128 adjacent the anti-tampering bead on the bolt is approximately 0.391 inches in diameter. In a specific embodiment, the lock body may be manufactured from sixteen gauge sheet metal formed in a draw die.

Similarly in a specific embodiment, the lock 130 may be formed on a standard transfer die from spring steel. The lock 130 has an axial length of 0.494 inches, a top opening 136 of 0.388 inches in diameter, and an exterior diameter of 0.556 inches. Each of the slots extend the entire length of the clip except for 0.94 inches of the axial wall depth and have a thickness measurement of about 0.063 inches. In a specific embodiment, the spring clip can be manufactured from 0.015 inch sheet spring steel.

In operation, each of the security seals 10, 50 and 110 function similarly. Each of the security seals 10, 50 and 110 whether straight, bent or equipped with a head and a lock body or two lock bodies as shown in FIGS. 2 and 3 through 6, function similarly. Whether or not the security seals 10, 50 or 110 have a head 22 and a lock body 24, 100 or 120 or a pair of lock bodies 24, 100, 120 or is straight, bent or U-shaped, each are positioned within their respective types of hasps on closed doors of locked railroad cars, truck, shipping containers and the like. Each of the seals 10, 50 and 110 can be utilized to seal a lock or to provide a security seal as the seal cannot be removed from the hasp without either removing the head or one of the lock bodies 10, 100 or 120 from at least one end thereof, or by snipping the bolt thereby providing visual evidence of tampering.

Security seals 10, 110 provide security seals which are more easily removable than the security seal 50 in as much as the bolt is tubular not solid. Thus, these seals provide a new and improved security seal which in most instances is used with other locking devices but which more inexpensively manufactured from solid bolt security seals. If a more robust security seal is required, modified security seal 50 provides a new and improved robust security seal of the solid bolt variety.

Each of the security seals of the invention provide a new and improved security seal which is less expensive to manufacture. Each of the security seals also provide a new and improved bolt seal which is more secure than prior seals which is less likely to hide tampering. The security seals of the invention provide a new and improved bolt seal which is easily removed using readily available tools and meets all of the requirements of both bolt seals which allow the seal to slide along the bolt and bolt seals which position the head and the seal adjacent the hasp to make tampering more difficult and bolt seals that can be removed without specialized tooling.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto.

What is claimed is:

1. A cargo security seal comprising a lock body having an elongated bore of uniform diametral size, a groove in said bore, and an expandable ring in said groove, said groove having two generally planar spaced apart lock surfaces extending generally perpendicular to said bore, said ring being expandable from a diameter smaller than the diameter of said bore to a diameter larger than the diameter of said bore, an elongated bolt having opposite ends and a diametral size smaller than said bore, said bolt having a ring expander adjacent one of said opposite bolt ends and an anti-tampering and stop device spaced therefrom, said ring expander having a diametral size larger than said bolt and smaller than said bore, both said ring expander and said anti-tamper and stop device having facing generally planar lock surfaces extending generally perpendicular of said bolt, said ring expander having a diameter substantially filling said bore, said anti-tamper and stop device essentially closing said bore, said bolt being locked in said bore by inserting said one end into an end of said bore and moving said lock body toward said anti-tampering and stop device whereby said ring expander expands said expandable ring into said groove to allow said ring expander to pass therethrough and to position said expandable ring between said lock surfaces on said ring expander and said anti-tampering and stop device thereby preventing said bolt from being removed from said bore by the engagement of said lock surfaces with said expandable ring, said ring expander and said anti-tampering and stop device preventing access to said expandable ring without the destruction of said lock body or said bolt.

2. The cargo security seal of claim 1 wherein said ring expander comprises a ring secured to said bolt extending radially outwardly of said bolt and surrounding said bolt, said ring having at least one lock surface extending radially outwardly of said bolt and generally perpendicularly of said bolt facing away from said one end.

3. The cargo security seal of claim 2 wherein said ring is tapered toward said one end.

4. The cargo security seal of claim 1 wherein said anti-tampering and stop device comprises a ring secured to said bolt extending radially outwardly of said bolt and surrounding said bolt, said ring having at least one lock surface extending radially outwardly of said bolt and generally perpendicularly of said bolt and facing said one end.

5. The cargo security seal of claim 1 wherein said anti-tampering and stop device are complementary surfaces of said bolt and said lock body which block access to said groove and expandable ring therein.

6. The cargo security seal of claim 1 wherein said anti-tampering and stop device is a complementary step diametered joinder between said bolt and said lock body.

7. The cargo security seal of claim 1 wherein said expandable ring is a snap ring.

8. The cargo security seal of claim 1 wherein said expandable ring is a C-shaped ring.

9. The cargo security seal of claim 1 further comprising an enlarged head on the other of said bolt ends.

10. The cargo security seal of claim 9 wherein said head is an integral part of said bolt.

11. The cargo security seal of claim 9 wherein said head is formed separately from said bolt and secured to said bolt.

12. The cargo security seal of claim 1 wherein said bolt is formed of a metallic tube.

13. The cargo security seal of claim 1 wherein said bolt is formed of a solid metal rod.

14. The cargo security seal of claim 1 wherein said bolt has a tapered portion between said groove and said one end.

15. The cargo security seal of claim 1 wherein said lock body is a tubular body having a groove therein, and said ring expander is a ring secured to said bolt and having a surface extending radially outwardly from said bolt facing away from said one end.

16. The cargo security seal of claim 15 wherein said ring is spaced from said anti-tampering device axially of said bolt and is positioned between said groove and the other of said opposite bolt ends.

17. The cargo security seal of claim 1 wherein said bolt is bent.

18. The cargo security seal of claim 1 wherein said bolt is U-shaped and has identical opposite ends adapted to be placed within identical lock bodies, said lock bodies being spaced apart and secured together.

19. The cargo security seal of claim 1 wherein said bore extends through said lock body.

20. The cargo security seal of claim 1 wherein said anti-tampering device is adjacent to the other of said bolt ends.

21. The cargo security seal of claim 1 wherein said bolt is a thin walled tube.

22. The cargo security seal of claim 21 wherein said ring expander is a bead on said tube.

23. The cargo security seal of claim 2 wherein said anti-tampering device is a bead on said tube.

24. The cargo security seal of claim 21 wherein said stop is a bead on said tube.

25. The cargo security seal of claim 21 further comprising a head on said bolt at the other of said opposite bolt ends, said head being a bead on said tube.

26. The cargo security seal of claim 21 wherein said anti-tampering device and said stop are the same bead on said tube.

27. The cargo security seal of claim 26 wherein said bead having a diameter larger than said bore of said lock body.

28. The cargo security seal of claim 21 further comprising a head on said bolt at the other of said opposite bolt ends, said head being a beading of said tube.

29. The cargo security seal of claim 1 wherein said anti-tampering device is a second spaced apart ring expander in said bore.

30. The cargo security seal of claim 1 wherein said anti-tampering device is a ring larger in diameter than said bore.

31. The cargo security seal of claim 1 wherein said anti-tampering device and said ring expander both have a diameter substantially filling said bore and being spaced apart on said bolt a distance less than the distance between said groove in said bore of said lock body and said bore end.

32. The cargo security seal of claim 1 wherein said anti-tampering device has a diameter greater than said ring expander and said bore and being spaced apart from said bolt a distance greater than the distance between said groove in said bore and said bore end.

33. The cargo security seal of claim 1 further comprising a head on said bolt at the other of said opposite bolt ends.

34. The cargo security seal of claim 33 wherein said head is a piece of a material having a bore therein in which said bolt is positioned and secured, said piece having a size larger than said bolt.

35. The cargo security seal of claim 33 wherein said head is said stop.

36. The cargo security seal of claim 33 wherein said head is said anti-tampering device.

37. The cargo security seal of claim 1 wherein said expandable ring is a filament of spring steel spirally wound around a mandrel at least two revolutions.

38. The cargo security seal of claim 1 wherein said lock body is one leg of a U-shaped lock body having two legs, the other leg of said lock body having a second bore therein, said second bore being coaxial with said bore of said lock body, whereby said bolt may be positioned in both bores and locked in said one leg.

39. The cargo security seal of claim 1 wherein both of said legs of said U-shaped lock are lock bodies, said bores of both said lock bodies being coaxial whereby said bolt may be positioned in both of said bores and locked in both of said bores.

40. The cargo security seal of claim 1 wherein said bore is step diametered, said bolt being stepped diametered, and said anti-tampering device is said step diametered bore and bolt positioned complementary to each other when said expandable ring is adjacent said lock surface.

41. The cargo security seal of claim 1 wherein said bore is in said lock body, said bore having opposite ends, said one end being open, said other end being closed.

42. The cargo security seal of claim 1 wherein said bolt is U-shaped, said bolt having opposite ends, said lock bodies having a pair of elongated bores of uniform diametral size extending into said body, both of said bores having a groove therein and an expandable ring in said groove, whereby both legs of said U-shaped bolt may be locked in said bores of said lock body.

43. The cargo security seal of claim 1 wherein said bolt is a rod, said ring expander and said anti-tampering device are portions of said bolt on opposite sides of said lock surfaces have a diameter essentially filling said bore.

44. The cargo security seal of claim 1 wherein said lock surfaces are facing generally planar surfaces of a groove in said bolt positioned between the opposite ends thereof and extending generally perpendicularly of said bolt.

45. The cargo security seal of claim 1 wherein said stop is one of said surfaces of said groove.

46. A cargo security seal comprising a lock body having an elongated bore of uniform diametral size, a groove in said bore, and an elongated bolt having opposite ends and a diametral size smaller than said bore, said bolt having a groove therein and an expandable ring in said bolt groove, said bolt groove having two generally planar spaced apart lock surfaces extending generally perpendicular of said bolt, said bore groove having two generally planar spaced apart lock surfaces extending generally perpendicular to said bore, said expandable ring in said bolt groove, said ring being collapsible from a diameter larger than the diameter of said bolt to a diameter smaller than the diameter of said bolt, said bolt having a diameter substantially filling said bore, said bolt being locked in said bore by inserting one of said ends of said bolt into said bore and moving said lock body toward the other of said ends of said bolt, whereby said expandable ring expands into said bore groove to position said expandable ring between said lock surfaces of said bore groove and said lock surfaces of said bolt groove thereby preventing said bolt from being removed from said bore by the engagement of said lock surfaces with said expandable ring, said bolt and said bore preventing access to said expandable ring without the destruction of said lock body or said bolt.

47. The cargo security seal of claim 46 wherein said expandable ring is a snap ring.

48. The cargo security seal of claim 46 wherein said expandable ring is a C-shaped ring.

49. The cargo security seal of claim 46 wherein said expandable ring is a ring of spirally wrapped spring steel.

50. The cargo security seal of claim 46 wherein said bolt is formed of a metallic tube.

51. The cargo security seal of claim 46 wherein said bolt is formed of a solid metal rod.

52. A cargo security seal comprising an elongated bolt having opposite ends, a lock retainer on said bolt adjacent at least one of said opposite bolt ends, and an anti-tampering device on said bolt between the other of said opposite bolt ends and said lock retainer, and a lock body with a lock therein removably securable to said bolt at said one bolt end by said lock retainer and said anti-tampering device adjacent to said lock body, said lock retainer and said anti-tampering device preventing access to said lock, whereby said lock body cannot be removed from said bolt without destruction of said bolt or lock body, said lock body including a cap and a spring therein, said spring being a slotted ring having a top and a bottom with top and bottom openings therein, said bottom opening having a diameter slightly larger than the diameter of said bolt, said top opening having a diameter slightly smaller than the diameter of said bolt, said slotted ring having slots extending from said top a partial length of said ring toward said bottom, said cap having a step diametered body, said cap body having a larger diameter portion for enclosing said spring and a smaller diameter portion for enclosing said one bolt end, and an opening therein in which said bolt is positioned, said opening having a diameter slightly larger than the diameter of said bolt and smaller than said lock retainer and said anti-tampering device.

53. The cargo security seal of claim 52 wherein said expandable ring is a ring of spirally wrapped spring steel.

54. A cargo security seal comprising an elongated bolt having opposite ends, a lock retainer on said bolt adjacent at least one of said opposite ends, and an anti-tampering device on said bolt between the other of said opposite ends and said lock retainer, and a lock body with a lock therein removably securable to said bolt at said one end by said lock retainer, said anti-tamper device being adjacent to said lock body, said lock retainer and said anti-tampering device preventing access to said lock, whereby said lock body cannot be removed from said bolt without destruction of said bolt or lock body, said bolt having lock retainers and anti-tampering devices adjacent to both of said ends, and two lock bodies, one for each end.

55. The cargo security seal of claim 54 wherein both said bolt ends and said lock bodies are identical.

56. A cargo security seal comprising an elongated bolt having opposite ends, a lock retainer on said bolt adjacent at least one of said opposite ends, and an anti-tampering device on said bolt between the other of said opposite ends and said lock retainer, a lock body with a lock therein removably securable to said bolt at one of said opposite bolt ends by said lock retainer and said anti-tampering device adjacent to said lock body, said lock retainer and said anti-tampering device preventing access to said lock, whereby said lock body cannot be removed from said bolt without destruction of said bolt or lock body, said bolt being tubular having an interior passageway extending therethrough and has a global positioning system being positioned within said passageway.

57. A cargo security seal comprising an elongated bolt having opposite ends, a lock retainer on said bolt adjacent at least one of said opposite ends, and an anti-tampering device on said bolt between the other of said opposite ends and said lock retainer, and a lock body with a lock therein removably securable to said bolt at said one end by said lock retainer and said anti-tampering device adjacent to said lock body, said lock retainer and said anti-tampering device preventing access to said lock, whereby said lock body cannot be removed from said bolt without destruction of said bolt or lock body, said bolt being tubular having an interior passageway extending therethrough and has an electronic tamper evident device begin positioned within said passageway.

58. The cargo security seal of claim 53 wherein said top opening is smaller in diameter than said lock retainer and said anti-tampering device.

59. A cargo security seal comprising an elongated bolt having opposite ends, a lock retainer on said bolt adjacent at least one of said opposite ends, and a anti-tampering device on said bolt between the other of said opposite ends and said lock retainer, and a lock body with a lock therein removably securable to said bolt at said one end by said lock retainer and said anti-tampering device adjacent to said lock body, said lock retainer and said anti-tampering device preventing access to said lock, whereby said lock body cannot be removed from said bolt without destruction of said bolt or lock body, said bolt being step diametered and said lock body is a step diametered cap having a closed end and an open end, said step diametered cap having a larger step diametered portion adjacent said open end and a smaller step diametered portion adjacent said closed end, said cap having a groove in said smaller step diametered portion, said bolt having a smaller step diametered portion adjacent said one end, and a groove in said smaller step diametered portion of said bolt, both said grooves having a bottom and upstanding side wall generally perpendicular of said bolt and cap, respectively, said step diametered portions of said bolt and cap being generally complementary when said grooves are aligned.

60. A cargo security seal comprising a lock body having an elongated bore of uniform diametral size extending into said body, a groove in said bore, an expandable ring in said groove, said ring being expandable from a diameter smaller than the diameter of said bore to a diameter larger than the diameter of said bore, an elongated bolt having opposite ends and a diametral size smaller than said bore, said bore and bolt having diametral sizes chosen to provide sliding tolerances, said bolt having a groove therein into which said expandable ring may expand whereby said bolt may be positioned within said bore and locked therein by said expandable ring expanding into said groove of said bolt, said bolt substantially filling said bore on both sides of said expandable ring and essentially closing said bore to access to said expandable ring said bolt groove having two generally planar spaced apart lock surfaces extending generally perpendicular of said bolt, said bore groove having two generally planar spaced lock surfaces extending generally perpendicular to said bore whereby said lock body cannot be removed from said bolt without destruction of said bolt or said lock body.

* * * * *